US005312041A

United States Patent [19]

Williams et al.

[11] Patent Number: 5,312,041

[45] Date of Patent: May 17, 1994

[54] DUAL FLUID METHOD AND APPARATUS FOR EXTINGUISHING FIRES

[75] Inventors: Leslie P. Williams; Dwight Williams, both of Vidor, Tex.

[73] Assignee: CCA, Inc., Mauriceville, Tex.

[21] Appl. No.: 995,150

[22] Filed: Dec. 22, 1992

[51] Int. Cl.[5] ..... A62C 31/07; A62C 31/12

[52] U.S. Cl. ..... 239/8; 239/419.3; 239/423; 239/424; 169/14; 169/15; 169/70

[58] Field of Search ..... 169/14, 15, 43, 44, 169/46, 47, 70; 239/8, 9, 10, 418, 419, 419.3, 422, 423, 424, 424.5, 427.3, 427.5, 428

[56] References Cited

U.S. PATENT DOCUMENTS

| | | | |
|---|---|---|---|
| 1,431,789 | 10/1922 | Hamilton | 169/46 X |
| 2,259,500 | 10/1941 | Thompson | 169/14 |
| 2,853,139 | 9/1958 | Biro | 169/44 |
| 3,572,443 | 3/1971 | Guise et al. | 169/43 |
| 3,692,117 | 9/1972 | Wright | 169/15 X |
| 3,739,794 | 6/1973 | Lindgren | 169/44 X |
| 4,219,532 | 8/1980 | Messervey et al. | 239/427.5 X |
| 4,497,442 | 2/1985 | Williams | 239/437 |
| 4,640,461 | 2/1987 | Williams | 239/317 |
| 4,705,405 | 11/1987 | Williams | 366/160 |
| 4,781,467 | 11/1988 | Williams | 366/150 |
| 4,828,038 | 5/1989 | Willaims | 169/15 |
| 5,012,979 | 5/1991 | Williams | 239/416.5 |
| 5,167,285 | 12/1992 | Williams | 169/14 |

FOREIGN PATENT DOCUMENTS

| | | | |
|---|---|---|---|
| 3281667 | 11/1988 | Japan | 169/43 |

*Primary Examiner*—Andres Kashnikow
*Assistant Examiner*—Lesley D. Morris
*Attorney, Agent, or Firm*—Sue Z. Shaper

[57] ABSTRACT

Nozzle, apparatus and method for extinguishing fires that includes applying to a fire simultaneously a first fluid surrounded by a second fluid and that includes a nozzle for discharging a first fluid in a path surrounded by a second fluid.

24 Claims, 8 Drawing Sheets 75
71
VF
C
OA
L+F
M
B1
B
B2
SUPPLY OF L+F

FIG.12a
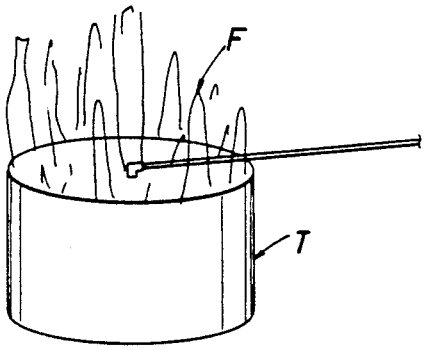
FIG.12b
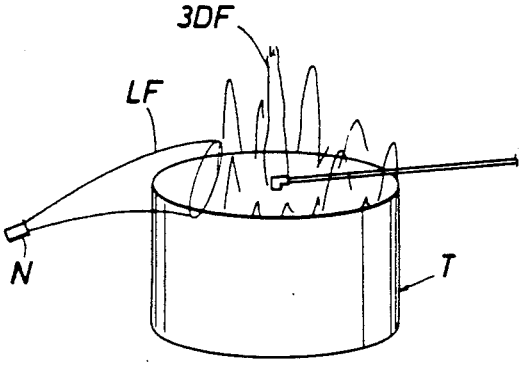
FIG.12c
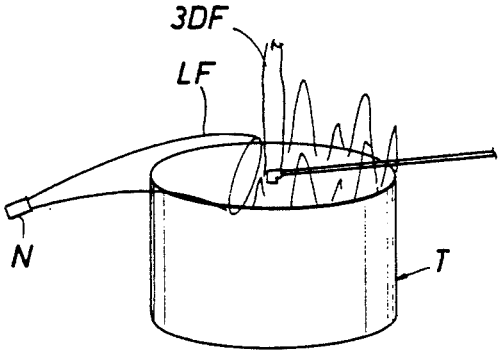
FIG.12d
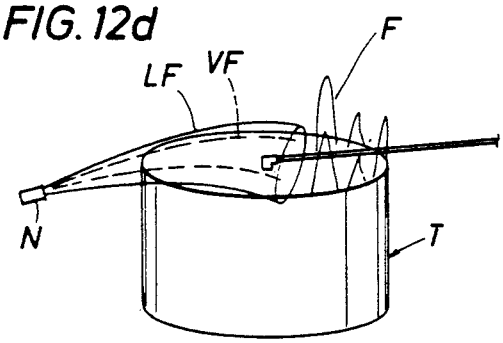
FIG.12e
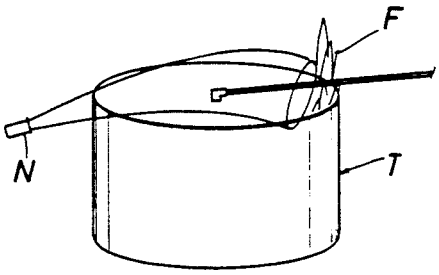
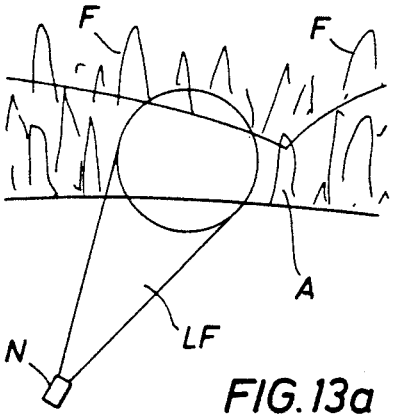
FIG.13a
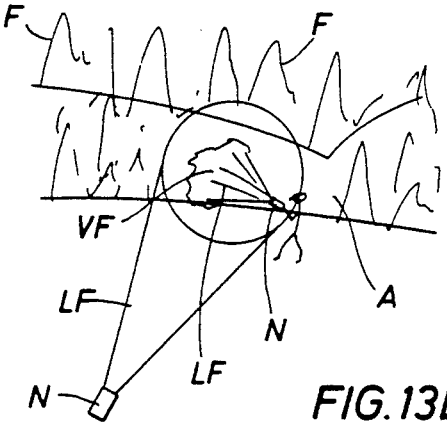
FIG.13b

DUAL FLUID METHOD AND APPARATUS FOR EXTINGUISHING FIRES

FIELD OF INVENTION

This invention relates to apparatus and method for extinguishing fires. In particular, the apparatus and method have applicability to large three dimensional fires.

BACKGROUND OF THE INVENTION

In the following discussion large complex industrial fires comprise the paradigmatic fires of interest. The burning of petrochemical storage tanks or tanker ships offer examples of such a large complex fires.

The so-called three dimensional fire, or a fire fed by a remote replenishing source, presents a fire fighter with a particularly troublesome scenario. The apparatus and method of the present invention are appropriate for attacking three dimensional fires in a complex industrial context. It is anticipated that the apparatus and method, however, have applications in many other fire extinguishing situations.

Method and apparatus for extinguishing fires using water, water fog and water foam mixtures are well known. Such method and apparatus are discussed and disclosed, for instance, in the inventor's U.S. Pat. Nos. 4,640,461, 4,497,442, 4,828,038, 4,705,405, 4,781,467 and 5,012,969.

A liquid and powder method and apparatus for fire fighting was recently determined to exhibit unexpected and startlingly effective results, particularly in fighting large conflagrations. This method and apparatus form the subject of the inventors' U.S.. Pat. No. 5,167,285.

The use of powder to extinguish fires, however, as mentioned above, has certain disadvantages. Powder is relatively expensive and difficult to store and to maintain over a long period of time in its dry particulate form. Further, a powder does not comprise the most desirable agent with which to flood an environment when human life is caught within the fire zone, such as may occur in an airplane crash.

Certain fluids are known for their effective fire fighting capability in a gaseous state, including certain common inert gases such as carbon dioxide and nitrogen. One reason such fluids in their gaseous state, or as vaporized, may be effective is that they may deprive the fire of oxygen, thereby effectively starving a fire to death. Alternately, the vapor or gas might be an effective fire extinguishing agent because it operates as a heat sink, a diluent in suppressing combustion, or inhibits oxidation. In sum, important fire extinguishing effectiveness may be achieved by a gaseous fluid through various operations, both physical and chemical.

Fluids that demonstrate effective fire fighting capability in a gaseous state when applied to a fire may lack some of the disadvantages of powder mentioned above. For instance, such fluids may be easier to store over time and can comprise a more favorable agent for use when human life is caught within the fire.

Attempting to deliver many gaseous or volatile, vaporizable fluids, however, by streaming or throwing the fluid to the fire, such as for a distance of 50 feet or more (which is a desirable distance to maintain from a large conflagration in the interest of managing personnel risk), has proven difficult in the past. As one example, effectively streaming carbon dioxide to a large fire has generally been conceded to be difficult. A blunderbuss type of a horn nozzle has been known for the application. The horn end of the nozzle is several feet long. Unfortunately, the outlet end of the horn must be virtually placed on the fire to effectively deliver the gas, since by the nature of the gas, it quickly diffuses and dissipates when dispensed into the atmosphere. The proximity of the fire fighter to the fire required to so deliver the gas renders the horn almost useless in fighting large fires. As a general matter, for many desirable gases or highly volatile fluids, it has been conceded to be impracticable heretofore to attempt to deliver the fluids to a large fire in sufficient quantities, and with the right timing, to comprise an effective fire fighting technique.

Given the difficulty in delivering many desirable gases or volatile fluids to large fires, a system for teaching the effective use of such fluids together with other fire fighting techniques and agents has also been lacking. The present invention addresses these problems and deficiencies.

The present invention discloses apparatus and method that achieves surprising and unexpected results. Apparatus is disclosed that enhances the effective and efficient delivery of fluids to a fire, including gaseous fluids and highly volatile fluids and/or fluids that vaporize rapidly upon contact with the fire. (These types of fluids, some of them historically difficult to use in streaming applications, are sometimes referred to herein as "gas fluids".) Methods for extinguishing fire by the delivery of a gas fluid to the fire are also disclosed. The effective and efficient results are achieved by delivering a first gas fluid surrounded by a second liquid fluid. The discovery of the effectiveness of such delivery in a quantity, in a state, at a time, and in a combination with other activities, such that the first fluid at the fire can exert a significant fire fighting effect, is novel.

The term "liquid fluid" as used herein is intended to refer to a fluid or fluid mixture that assumes or retains a liquid state under general atmospheric conditions. Such common liquid fluids may comprise water, foam, water and foam, water and foam concentrate, or other liquid fluid mixtures known to have beneficial fire fighting properties. "Fluid" is used herein to refer to a substance in its liquid or gaseous state.

It is believed that the success of the invention is due in part to multiple synergistic effects experienced in the simultaneous delivery and application to a fire of a first fluid surrounded by a liquid fluid. For instance, the simultaneous delivery process, wherein a first fluid is delivered through the atmosphere within the envelope of a liquid fluid, may itself enhance the fire fighting effectiveness of both fluids. The liquid fluid envelope may not only enhance the streaming of an enclosed fluid or gas, it may permit the shaping and directing of the placement of the first fluid over the fire. The ability to tailor the shape of the envelope allows the area of contact of the first fluid to be controlled, enabling the first fluid to be applied to the totality of a targeted fire area. This marks a noted improvement over present art experience that may include shooting a hole in a fire through too narrow of an application of a gas fluid. The envelope may also enhance the retention of any first fluid upon the fire. Further, the first fluid, or a portion thereof, may become entrained within the liquid fluid envelope, or a portion thereof, during the delivery process. This entraining may enhance the delivery of the first fluid. The entraining may also enhance the retention of the first fluid at the fire after delivery. Also, the first fluid, especially if a volatile liquid, by its expansion, agitation and/or entrainment after discharge from its orifice, may enhance the foaming of the liquid foam mixture envelope during delivery. This assumes that the second fluid is capable of enhanced foaming. Enhanced foam usually improves the fire fighting capability of a liquid foam mixture.

SUMMARY OF THE INVENTION

The dual fluid nozzle and apparatus of the present invention comprises a nozzle having two conduits coupled to each other. The first conduit receives a first fluid, which might comprise a volatile liquid fluid, a liquid gas or a gas. More particularly, in the preferred embodiment, the first fluid may comprise an inert gas or most particularly, carbon dioxide. This first fluid can be received in and discharged from the first conduit in either liquid or gaseous form.

The second conduit is adapted to receive a second fluid, such as water, water foam or a water and foam concentrate mixture. The water and foam may be premixed prior to entering the conduit or mixed and foamed within the second conduit. In some embodiments a foam concentrate is educted into the nozzle and mixed therein with water prior to being discharged as a water and foam liquid combination.

The first fluid is discharged from the first conduit via a first conduit orifice and the second fluid is discharged from the second conduit via a second conduit orifice. The first and second orifices are relatively sized and relatively positioned such that the discharged first fluid is surrounded by an envelope comprising the discharged second liquid fluid. The discharged first fluid travels within the envelope defined by the second fluid.

Many useful means for supplying the second fluid, such as water, water/foam and/or water and foam concentrate, to the second conduit of the nozzle are known in the art. Any of the known means for supplying such fluids to the conduit should suffice.

Means for supplying a first fluid to a first conduit are also known in the art, including means for supplying gaseous fluids, liquid gases and volatile fluids. Such means could comprise, for instance, a line attached to a bottle with fittings to attach the end of the line to the first conduit. The first fluid can enter and be discharged in liquid or gaseous form. A source of pressure controls the entry of the fluid.

The flow path of the second fluid as it is discharged from the second orifice preferably comprises a cone. (The term cone, as used herein, encompasses a cylinder as a special case.) In preferred embodiments, the cone is hollow. The first fluid is discharged from the first conduit orifice such that its flow path is contained within the cone envelope. As the two fluids travel to the fire, the first fluid may comprise a gas or may vaporize in flight. Alternately, the first fluid may vaporize at the fire. A gas or vapor in transit tends to fill the envelope defined by the liquid fluid trajectory, and, it is believed, a portion of such gas or vapor may penetrate and become entrained within the second liquid fluid envelope during flight.

The method of the present invention comprises applying to a fire simultaneously a first gas fluid surrounded by a second liquid fluid. A preferred first fluid comprises an inert gas at atmospheric conditions, such as carbon dioxide. Preferably, the first and second fluids are delivered to the fire from a distance of at least 50 feet. The second fluid is a liquid and preferably includes a foam or foaming agent. A film-forming foam is suitable in many applications.

The method may include initially applying to the fire the liquid fluid, preferably a water/foam composition, without the first fluid. The liquid fluid is initially applied broadly to the fire and then more narrowly as the volume of the fire diminishes. When the fire has been reduced in size and breadth, then the first gas fluid, preferably comprising an inert gas such as carbon dioxide, is delivered to the fire simultaneously with and surrounded by the liquid fluid envelope.

BRIEF DESCRIPTION OF THE DRAWINGS

FIG. 2A is a cross-sectional view taken along line 2A—2A in FIG. 2.

FIGS. 12*a* through 12*e* and FIGS. 13*a* and *b* illustrate other preferred methods of this invention.

DESCRIPTION OF THE PREFERRED EMBODIMENT

FIGS. 1–5 illustrate five embodiments of a nozzle and apparatus for the simultaneous application of dual fluids to a fire. The nozzle is comprised of second conduit or barrel B, made up in the preferred embodiment of two portions referred to as B1 and B2. B1 telescopicly slides over B2 from its leftmost open position, shown, to its rightmost and most closed position, where stop 62 abuts shoulder 64. With B1 in its leftmost position, liquid fluid LF is discharged in the broadest pattern. With the barrel in its rightmost position, liquid fluid LF if discharged in its narrowest pattern.

The pattern of discharge of the second fluid, or liquid fluid LF, from the nozzle of FIGS. 1–5 tends to assume the shape of a hollow cone, discussed further below. The breadth of the cone is affected by the relative position of B1. The conical shape tends to be hollow because of the obstruction to flow provided by elements O and OO and mixing chamber M located in the second conduit or barrel, of FIGS. 1–5, also more fully discussed below.

Figure 1:
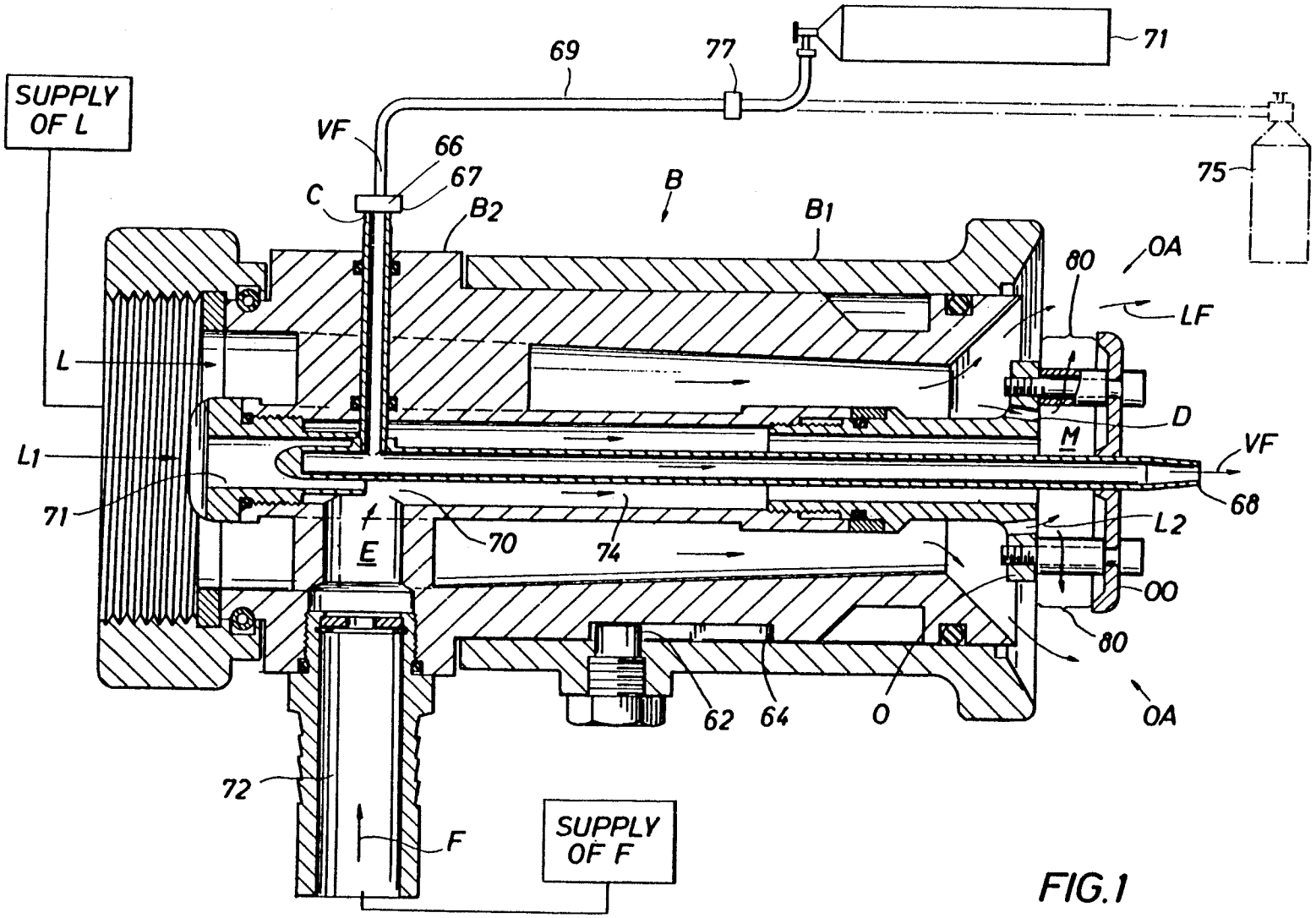
FIGS. 1 through 5 offer cross-sectional views of five embodiments of a dual fluid nozzle and apparatus.

First conduit C of FIG. 1 contains an inlet 66 having a fitting 67 and outlet orifice 68. First fluid, designated VF, is illustrated as supplied in this embodiment from bottle 71 through line 69. Alternately, first fluid VF is supplied from bottle 75 through lines 73 and 69 as shown by dashed lines in FIGS. 1–5. If the first fluid VF comprises carbon dioxide, standing the bottle on end, as shown by dashed lines, may suffice to supply gaseous carbon dioxide while laying the bottle on its side may suffice to supply liquid carbon dioxide. Regulator 77 may be installed in the line between a bottle and the nozzle. Fitting 67 aids in attaching the bottle line to the nozzle. Many means for supplying a fluid, including a liquid or a gas, to a nozzle are known in the art and most should suffice for the purposes of this invention. The means shown in the drawing are for illustrative purposes.

The first fluid VF supplied to the nozzle through inlet 66 is discharged from outlet 68 of first conduit C. A major portion of first conduit C is approximately aligned with the axis of the second conduit or barrel B.

In the preferred embodiment the first fluid may be supplied to the nozzle as a gas or a liquid under pressure. Second fluid L enters the second conduit or barrel of the nozzle from the left and proceeds generally through the barrel from left to right around structural obstructions. A portion of the liquid L1 in the embodiment of FIG. 1 flows through inlet 71 of eductor system E. Eductor system E is located within the center of the axial bore surrounding first conduit C. Liquid L1 that flows through eductor E enters chamber 70. In chamber 70, eduction pressure pulls foam concentrate F from an external source through conduit 72 and into the eductor chamber. The liquid L1 and foam concentrate F mix and flow through channel 74 surrounding a portion of the first conduit. The fluid L1 plus the foam F enter mixing chamber M defined between obstructions O and OO. Additional liquid L2 may enter mixing chamber M through ducts D in obstruction O. The liquid and foam exit mixing chamber M at annular outlet 80. This liquid and foam mixture mixes with the remainder of the liquid flowing through the outer portion of the axial bore of the second conduit or barrel. The total liquid and foam mixture is discharged from the annular second conduit orifice OA of the barrel. The direction of discharge is toward the right in the drawing.

Obstructions O and OO associated with mixing chamber M are located in the approximate center of the second conduit or barrel and in the outlet area of the barrel. Obstructions O and OO, together with mixing chamber M in the preferred embodiment of FIG. 1, cooperate with the second conduit or barrel such that the liquid foam stream LF discharged from the barrel is discharged in the configuration of a hollow cone.

Figure 2:
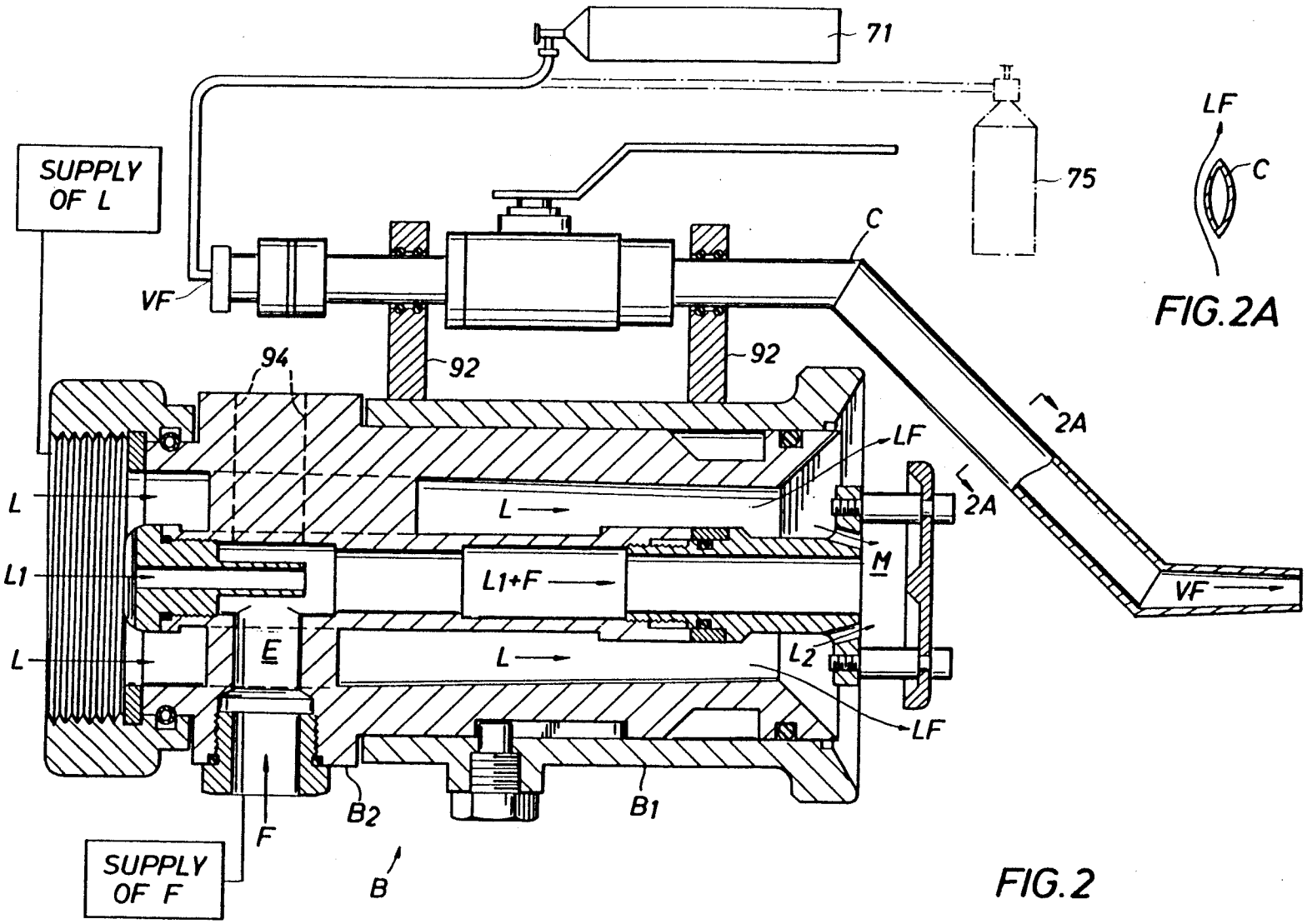

FIG. 2 comprises an alternate embodiment of a dual fluid nozzle. FIG. 2 differs from FIG. 1 predominantly in that the first conduit C is attached by means 92 to the outside of second conduit or barrel B. In particular, first conduit C is attached to portion B1 of barrel B. Dash lines 94 indicate in FIG. 2 that foam need not be educted by the eductor through only one eductor conduit. Indeed, foam concentrate F can be educted through multiple conduits. FIG. 2A illustrates a preferred design where a portion of first conduit C intersects the discharging second liquid foam mixture LF. FIG. 2A illustrates that, preferably, first conduit C at this portion would have an aerodynamic design such that the liquid foam stream would flow around the conduit in a path of least resistance and least turbulence.

Figure 3:
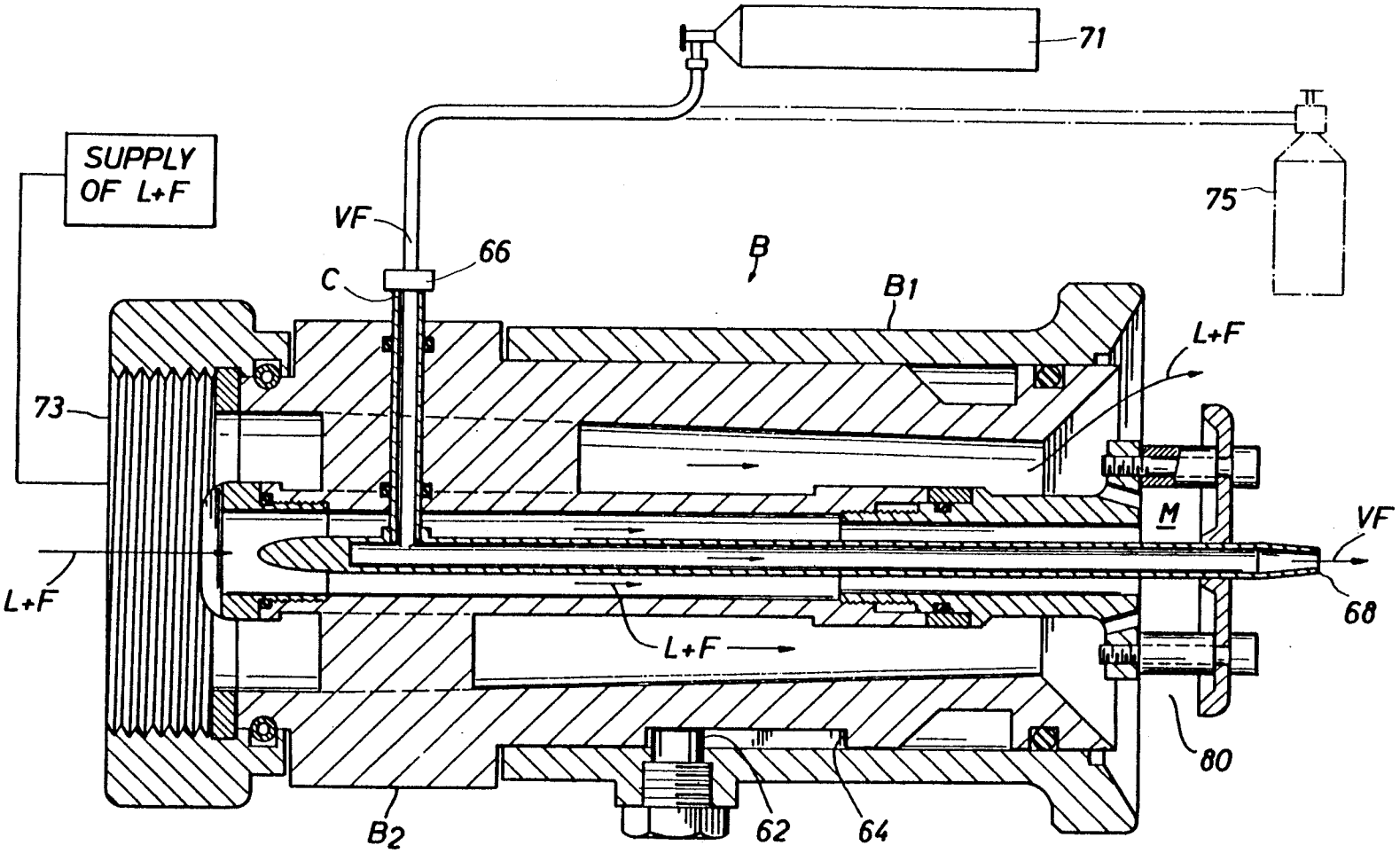

FIG. 3 illustrates an embodiment of the invention wherein the second fluid comprising the liquid and foam concentrate have already been combined before they enter the second conduit or barrel at inlet 73 on the left of B2. The liquid and foam combination may continue to flow in an inner path through the axial bore of second conduit or barrel B to mixing chamber M wherein a portion of the liquid and foam mixture is further aerated before joining a portion of the liquid and foam mixture that passes through the outer area of the axial bore. In FIG. 3, as in FIG. 1, the first fluid is supplied to first conduit C which contains a portion substantially aligned with the center of the axial bore of the barrel.

Figure 4:
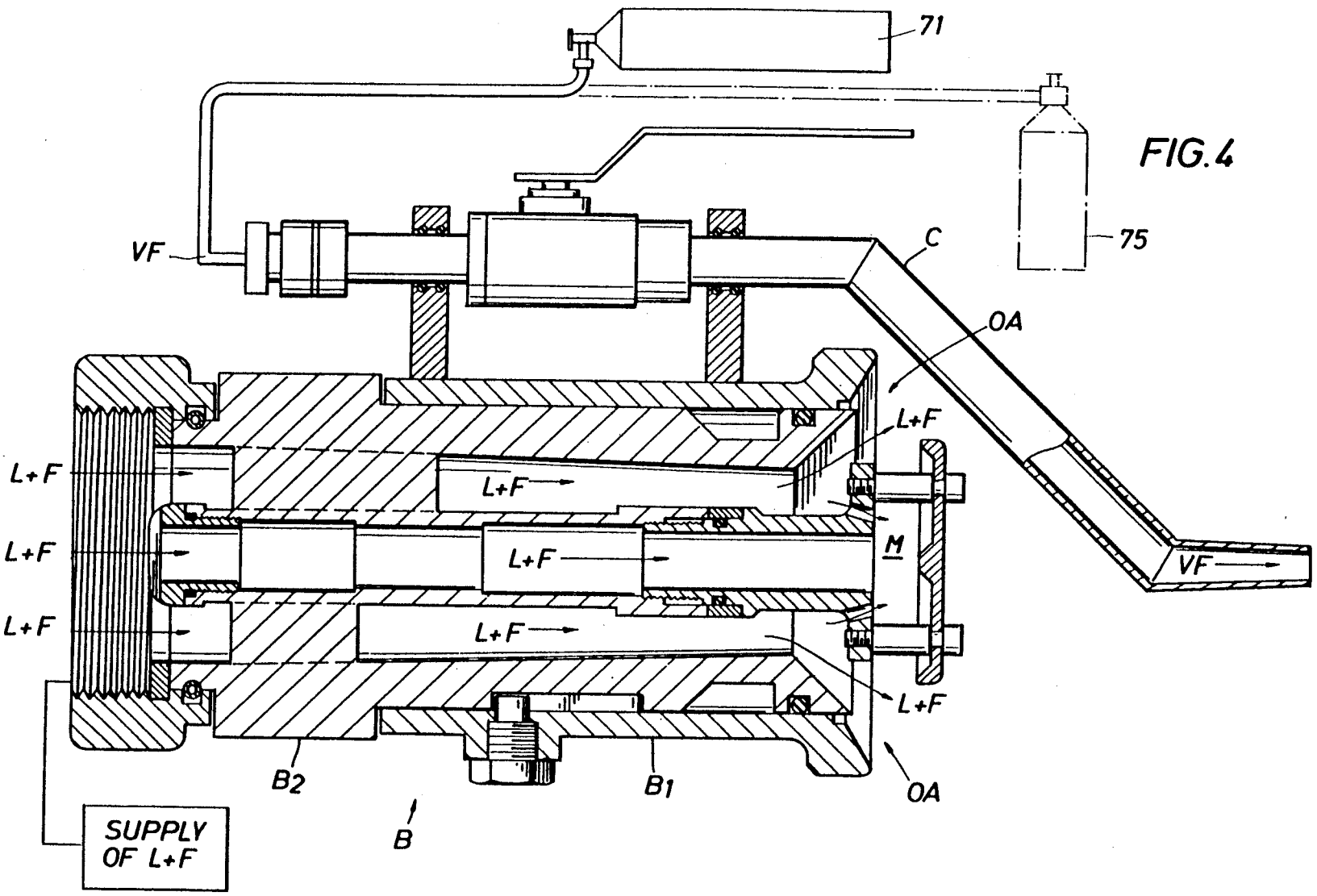

The embodiment of FIG. 4 is like the embodiment of FIG. 3 in that the second liquid L and foam concentrate F is supplied to the nozzle already mixed. The embodiment of FIG. 4 is like the embodiment of FIG. 2 in that the first fluid conduit C is affixed to the exterior of forward barrel B1. Again, since first conduit C itself intersects the liquid and foam spray emerging from the outlet orifice OA of second conduit or barrel B, preferably first conduit C embodies an aerodynamic design for a portion of its length in which the conduit intersects the path of the liquid fluid being discharged.

Figure 5:
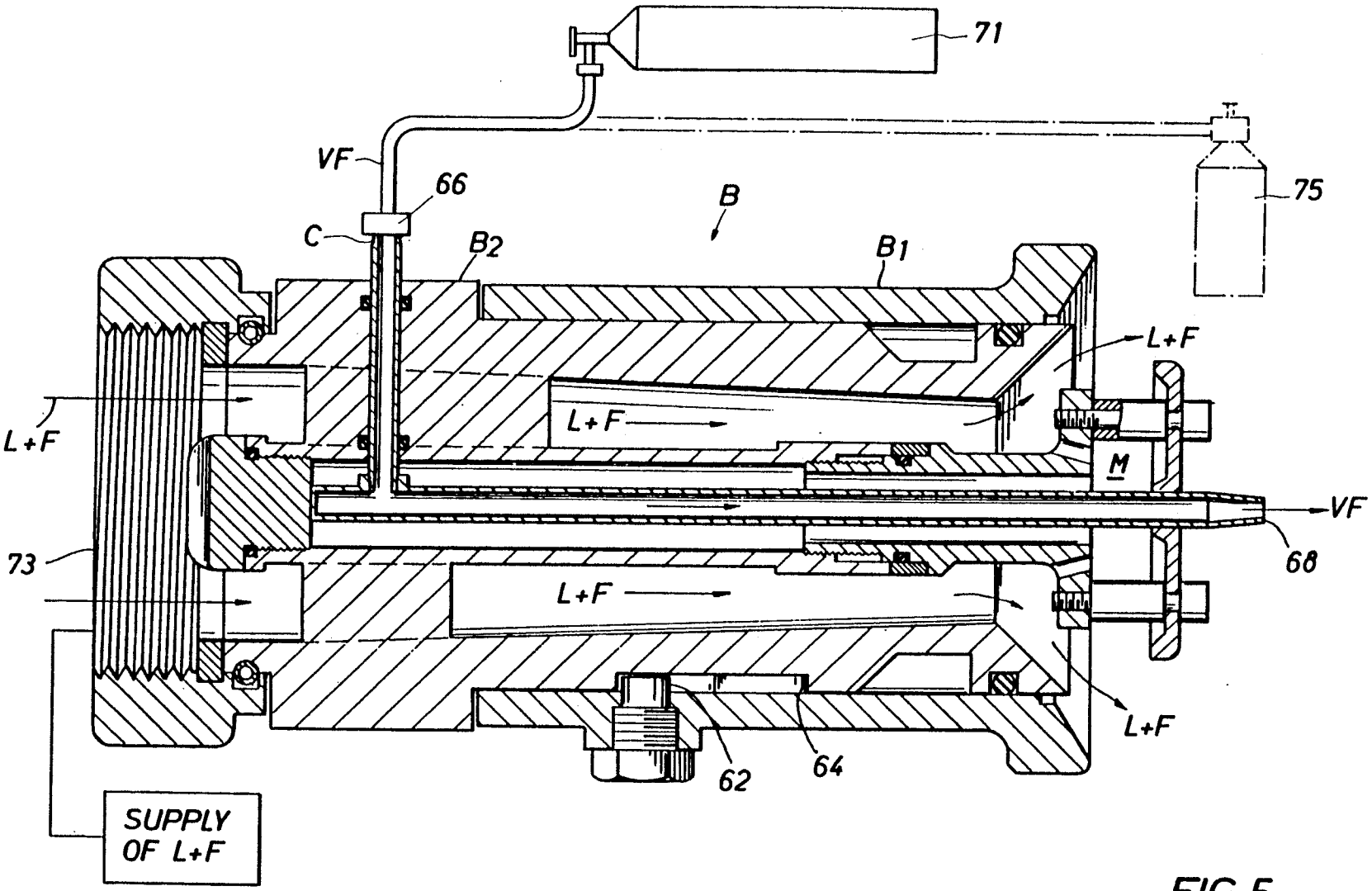
Figure 6:
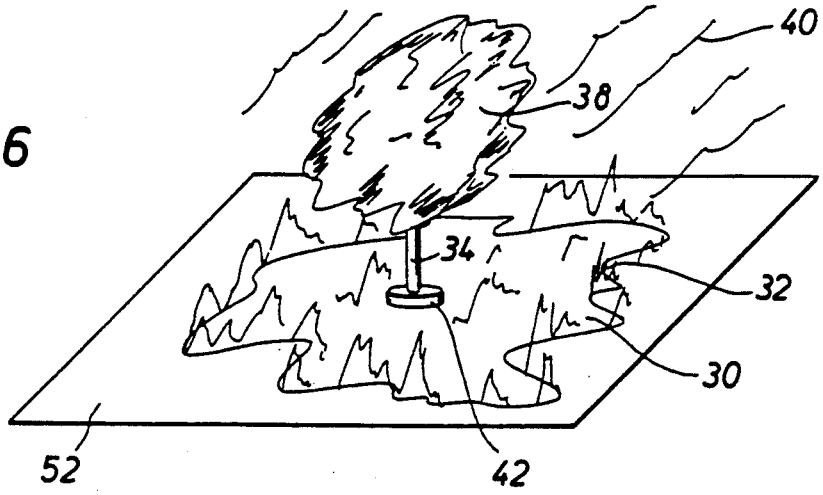
FIGS. 6 through 10 illustrate a preferred method of this invention as applied to a three dimensional fire.

The embodiment of the nozzle illustrated in FIG. 5 is like the embodiment of FIG. 3. That is, the liquid L and foam concentrate F are supplied already mixed to the inlet area 73 to the left on barrel portion B2 in the embodiment of FIG. 5. The liquid and foam comprising the second fluid, however, do not pass through a central portion surrounding the first fluid conduit C in the axial bore.

Figure 7:
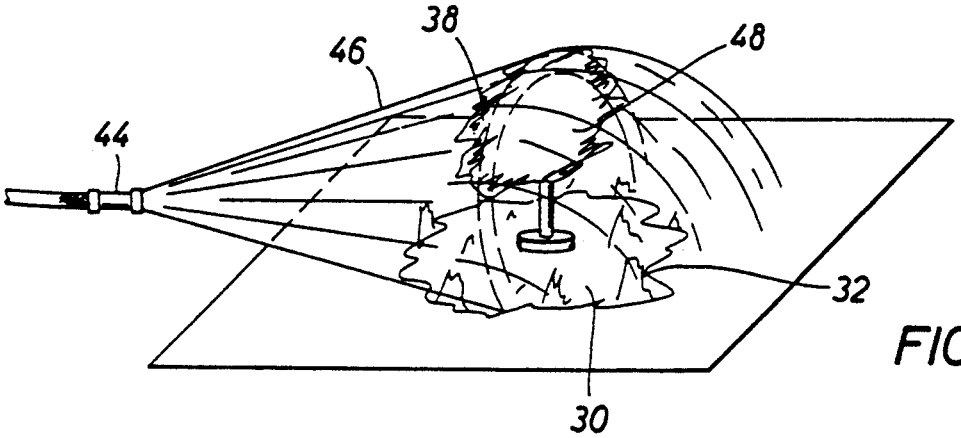
Figure 8:
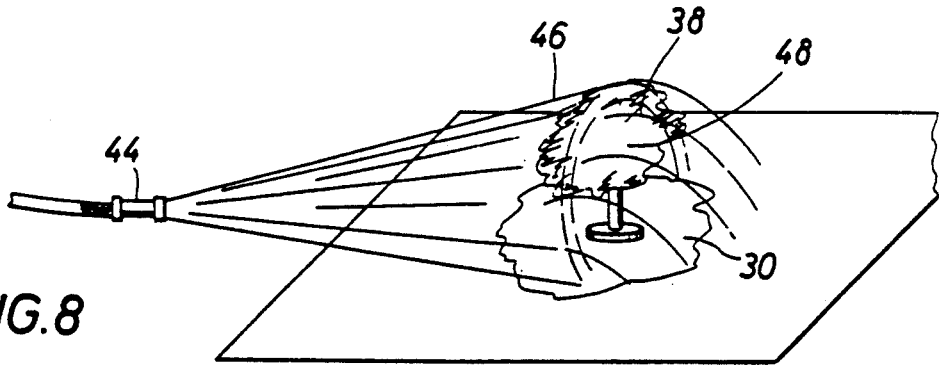
Figure 9:
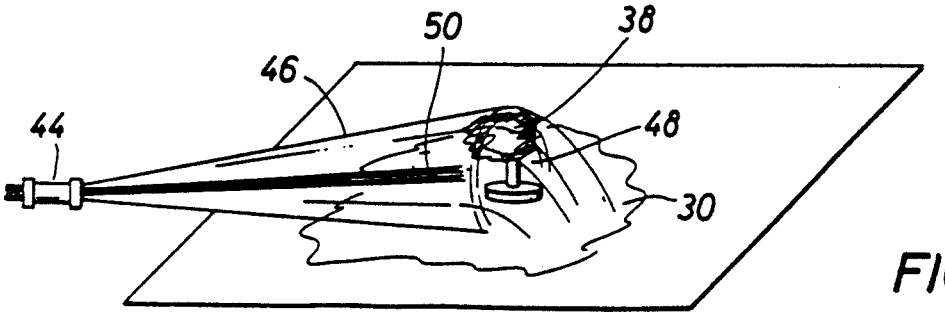
Figure 10:
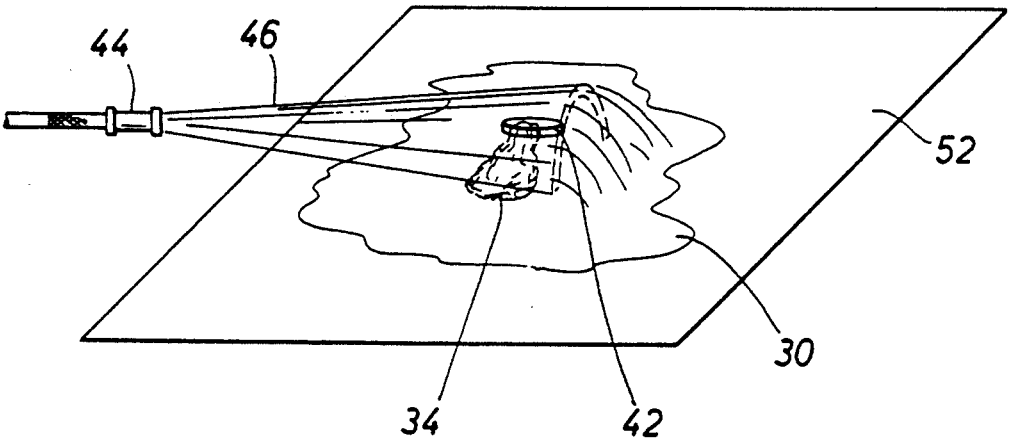

FIGS. 6–10 illustrate a preferred embodiment of the method of the present invention. Combustible fluid 34 is illustrated as spewing through outlet 42 under pressure from a remote source, creating a three-dimensional fire. The fire or combustion 38 of the fluid rises in the air, generating smoke 40. Pool 30 of the fluid forms on ground 52 and is encompassed by flames 32. In FIG. 7 nozzle 44 is brought to the three dimensional fire. A broad spray 46 of a liquid fluid, preferably liquid with a film forming foam composite, is applied to the fire in a breadth sufficient to encapsulate the fire, when possible. The liquid fluid spray is shown applied, in this embodiment, as a hollow cone. FIG. 7 indicates the hollow area of the cone. Upon the application of the liquid fluid spray the static fire 32 of pool 30 diminishes. FIG. 8 illustrates that the spray of liquid foam fluid has extinguished static fire 32 in pool 30 and has diminished the size of the three dimensional fire with combustion area 38. FIG. 8 also illustrates that the breadth of the liquid fluid spray 46 has been reduced as the extent of the three dimensional fire has been reduced. In FIG. 8 liquid fluid spray 46 is still being thrown in a configuration having a hollow center 48. FIG. 9 illustrates the application of a first fluid 50, discharging from nozzle 44 and being delivered to the fire as a gas predominantly through the hollow center of the envelope comprising the cone of liquid fluid spray 46. The static fire from pool 30 remains extinguished. The gas of the first fluid is directed to the diminished combustion portion 38 of the three dimensional fire. FIG. 10 illustrates ground area 52 with the fire extinguished. Liquid fluid spray 46 may continue to be applied to pool 30 and surging fluid 34, that now adds to pool 30. However, there is no more combustion or fire. The gas fluid, delivered to and retained upon combustion portion 38 of the fire by the hollow cone envelope of liquid fluid 46, completed the fire extinction process.

If the pool 30 of flames 32 is too large to be encompassed by a broad spray 46 of a liquid fluid from nozzle 44, as described above, an alternate fire fighting technique is illustrated in FIGS. 12*a* through 12*e*. The fire fighter begins at one edge of the flaming pool, illustrated as tank T, and applies the liquid fluid LF, preferably a liquid with a film forming foam composite. An edge of the fire F is extinguished thereby and this extinguished portion is gradually widened to include more of the pool, as illustrated in FIGS. 12*b* and 12*c*. If a three-dimensional fire 3 DF or segment of the fire F containing a burning area whose fuel is replenished from a remote source, is encountered within the pool, such as for instance might be offered by a dripping fuel line, then that element can be encompassed by an appropriately broad spray of the liquid fluid L while simultaneously a first fluid VF is discharged from the nozzle and applied, as in FIG. 12*d*. Without the simultaneous application of a suitable first fluid encompassed within the second liquid fluid, the 3 DF fire from the replenishing source may not be extinguishable. It might create a hole in the foam being applied to the pool, preventing the gradual systematic extinction of the fire in the full tank.

The disclosed method has further application in crash rescue fire fighting involving airplane crash fires, illustrated in FIGS. 13*a* and 13*b*. First, the engines may burn, offering a further example of a three-dimensional element, that is a spot of fire fed by a remote fuel source, in which the present invention can be utilized. Crash rescues also offer another possibility for the use of the dual fluid nozzle, apparatus and method. Frequently in such crashes it is desired to tunnel or cut a path through a thin film fire comprised of flammable liquid on the ground to reach the fuselage or cockpit of the plane. Suitable application of liquid foam can create a tunnel, as illustrated in FIG. 13*a*. In the fuselage or cockpit itself, it is desirable to quickly inert the atmosphere. This maneuver suggests the use of a first gas fluid delivered within an envelope of a liquid foam fluid, to inert the area, as illustrated in FIG. 13*b*.

Figure 11:
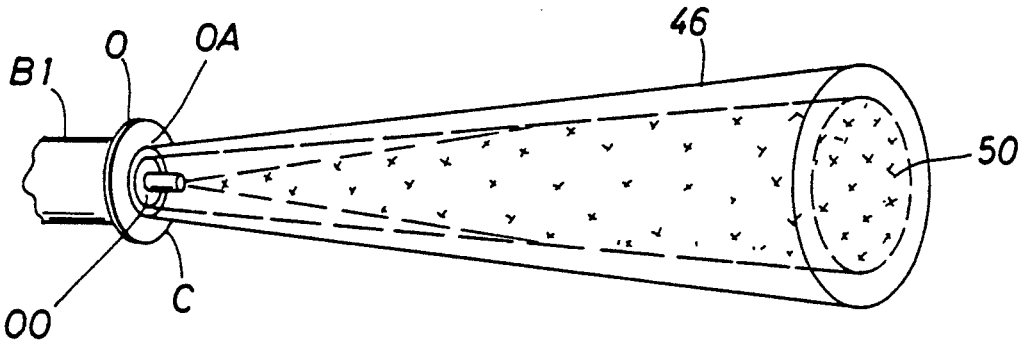
FIG. 11 illustrates a flow pattern for the delivery of dual fluid streams.

FIG. 11 illustrates a flow path of a first fluid 50 and a second fluid 46 wherein the first fluid is delivered within the envelope of the second fluid. In FIG. 11 the flow path of the second fluid is illustrated as that of a hollow cone. The flow path of the first fluid within the hollow cone envelope is illustrated as filling the interior space of the cone and partially becoming entrained within the second fluid envelope. If the first fluid is discharged as a liquid but vaporizes rapidly upon discharge, the cone or envelope of the liquid fluid may exhibit a bulge or widening at the point where rapid vaporization is taking place.

The foregoing disclosure and description of the invention are illustrative and explanatory thereof. Various changes in the size, shape and materials as well as the details of the illustrated construction may be made without departing from the spirit of the invention.

We claim:

1. A dual fluid method for the extinction of fires comprising discharging toward a fire from a nozzle simultaneously a first gas fluid distinct from and surrounded by a second liquid fluid.

2. The method of claim I wherein the first fluid comprises an inert gas at atmospheric conditions.

3. The method of claim 1 wherein the first fluid comprises carbon dioxide.

4. The method of claim 1 wherein the first and second fluids are delivered to the fire from a nozzle located at least 50 feet from the fire.

5. The method of claim 1 wherein the first and second fluids are delivered to the fire through the air and wherein the flow path of the second fluid assumes the shape of a cone and the flow path of the first fluid is contained within the cone envelope.

6. The method of claim 5 wherein the cone is a hollow cone.

7. The method of claim 5 that includes entraining at least a portion of the first fluid within at least a portion of the second fluid during delivery.

8. The method of claim 1 wherein the second fluid includes a foam.

9. The method of claim 8 wherein the foam comprises a film forming foam.

10. The method of claim 1 which further comprises initially applying to the fire the second liquid fluid without the first fluid.

11. The method of claim 10 that further comprises applying the initial liquid fluid in a broad spray to encapsulate the fire.

12. The method of claim 11 that further comprises reducing the breadth of the initial fluid applied as the volume of the fire diminishes.

13. A dual fluid nozzle and apparatus for the extinction of fires comprising a first conduit for receiving a first fluid and for discharging the fluid form a first conduit orifice;

a second conduit coupled to the first conduit for receiving a second fluid and for discharging the second fluid in liquid form from a second conduit orifice;

the first and second orifices being relatively sized and relatively positioned such that the first discharged fluid assumes a flow path distinct from and surrounded by the second discharged fluid;

means for supplying the first fluid to the first conduit; and means for supplying the second fluid to the second conduit.

14. The nozzle of claim 13 wherein the first fluid comprises a volatile fluid.

15. The nozzle of claim 13 wherein the first fluid comprises a gas at atmospheric conditions.

16. The nozzle of claim 13 wherein the first fluid comprises an inert gas.

17. The nozzle of claim 13 wherein the first fluid comprises carbon dioxide.

18. The nozzle of claim 13 wherein the first fluid is supplied to the first conduit in liquid form.

19. The nozzle of claim 13 wherein the first fluid is supplied to the first conduit in gaseous form.

20. The nozzle of claim 13 wherein a first portion of the first conduit is affixed to the exterior of the second conduit and wherein a second portion of the first conduit intersects a flow path of the discharged second liquid fluid.

21. The nozzle of claim 13 that includes an obstruction mounted within the second conduit such that the flow of a portion of the second fluid is obstructed within the nozzle.

22. A dual fluid nozzle for the extinction of fires comprising a first conduit for receiving a first fluid and for discharging the first fluid from a first conduit orifice;

a second conduit coupled to the first conduit for receiving a second fluid and for discharging the second fluid in liquid form from a second conduit orifice;

the first and second orifices being relatively sized and relatively positioned such that the first discharged fluid assumes a flow path surrounded by the second discharged fluid;

eductor means attached within the second conduit for educting a foam concentrate into the nozzle, the eductor means having a first inlet to receive a portion of the second fluid to create reduced pressure in the eductor and a second inlet to receive the foam forming concentrate; and a mixing chamber communicating with the eductor means, located in and discharging into the second conduit.

23. The nozzle of claim 22 wherein the first fluid comprises a volatile fluid.

24. The nozzle of claim 22 wherein the first fluid comprises a gas at atmospheric conditions.

* * * * *